US008757121B1

(12) United States Patent
Braun et al.

(10) Patent No.: US 8,757,121 B1
(45) Date of Patent: Jun. 24, 2014

(54) SUPPLYING SUPPLEMENTARY FUEL FOR ENGINE STARTUP

(75) Inventors: Matthew A. Braun, Caro, MI (US); Gary J. Burns, Millington, MI (US); Gerald J. LeMarr, Jr., Bay City, MI (US); Brent N. Schermerhorn, St. Joseph, MI (US); Mikio Sato, Kawasaki-machi (JP); Tsuyoshi Watanabe, Iwanuma (JP)

(73) Assignee: Walbro Engine Management, L.L.C., Tuscon, AZ (US)

( * ) Notice: Subject to any disclaimer, the term of this patent is extended or adjusted under 35 U.S.C. 154(b) by 1140 days.

(21) Appl. No.: 12/686,198

(22) Filed: Jan. 12, 2010

(51) Int. Cl.
*F02M 1/00* (2006.01)
*F02D 41/06* (2006.01)

(52) U.S. Cl.
USPC ..... 123/179.9; 123/179.16; 123/179.7; 123/438

(58) Field of Classification Search
USPC ..... 123/437–438, 179.7–179.9, 179.16; 261/DIG. 8, 38, 41.3
See application file for complete search history.

(56) References Cited

U.S. PATENT DOCUMENTS

| | | | | |
|---|---|---|---|---|
| 4,480,618 | A | 11/1984 | Kamifuji et al. | |
| 4,862,847 | A | 9/1989 | Kobayashi et al. | |
| 5,052,359 | A | 10/1991 | Hardwick et al. | |
| 5,060,617 | A * | 10/1991 | Kojima et al. | 123/435 |
| 6,293,524 | B1 * | 9/2001 | Endo et al. | 261/34.2 |
| 6,715,738 | B1 * | 4/2004 | Braun et al. | 261/71 |
| 7,040,282 | B2 * | 5/2006 | Andersson et al. | 123/335 |
| 7,198,028 | B2 * | 4/2007 | Andersson et al. | 123/339.11 |
| 7,264,230 | B2 * | 9/2007 | Burns et al. | 261/47 |
| 7,467,785 | B2 * | 12/2008 | Braun | 261/34.2 |
| 2005/0098907 | A1 * | 5/2005 | Richard et al. | 261/39.1 |
| 2007/0028881 | A1 * | 2/2007 | Nakata et al. | 123/179.15 |
| 2009/0013951 | A1 * | 1/2009 | Nakata et al. | 123/179.14 |
| 2011/0253102 | A1 * | 10/2011 | Watanabe | 123/438 |

* cited by examiner

*Primary Examiner* — Thomas Moulis
*Assistant Examiner* — Joseph Dallo
(74) *Attorney, Agent, or Firm* — Reising Ethington P.C.

(57) ABSTRACT

Supply of supplementary fuel is controlled through a supplementary fuel supply passage in a carburetor to an engine according to a variety of methods and devices.

19 Claims, 11 Drawing Sheets

SUPPLYING SUPPLEMENTARY FUEL FOR ENGINE STARTUP

FIELD OF THE INVENTION

The present invention relates generally to internal combustion engines and, more particularly, to condition responsive methods and apparatus for supplying supplementary fuel to an engine.

BACKGROUND OF THE INVENTION

Many small internal combustion engines are supplied with a combustible charge of air and fuel using a carburetor. A typical carburetor includes a body at least partially defining a liquid fuel chamber, an air and fuel mixing passage, and one or more fuel passages in communication between the fuel chamber and the air and fuel mixing passage. The fuel passages communicate with the mixing passage between an air inlet at an upstream end and an air-and-fuel mixture outlet at a downstream end. Typically, a choke valve is disposed in the air and fuel mixing passage near the upstream end to control a quantity of air flowing into the mixing passage during engine cold starting and warm up. A throttle valve is disposed in the air-and-fuel mixing passage near the downstream end to control a quantity or flow rate of the air-and-fuel mixture flowing out of the mixing passage to the operating engine.

In operation, engine pistons reciprocate and induce a pulsating vacuum through the carburetor such that air is pulled through the mixing passage toward the engine. This airflow induces a pressure differential in the carburetor, thereby causing liquid fuel to flow out of the fuel passages and into the air and fuel mixing passage where the fuel becomes mixed with air to create the air and fuel charge. The carburetor controls the combustible charge of air and fuel by controlling the flow of liquid fuel that becomes entrained in the mixing passage airflow, and by controlling the flow of air into the mixing passage and/or the flow of air-and-fuel mixture out of the mixing passage. More specifically, the carburetor may be manipulated to adjust an air-to-fuel (A/F) ratio in accord with varying engine requirements during engine startup, idle, steady-state operation, maximum power output, changes in load and altitude, and the like.

In one example, an operator may manually rotate the choke valve to a substantially closed or "choke-on" position such that vacuum in the mixing passage will be greater than when the choke valve is open. Thus, a greater quantity of fuel will be pulled into the mixing passage for a more fuel-rich A/F ratio for supply to the engine. In other words, the choke valve may limit the air flow rate through the mixing passage relative to the fuel flow rate to block or "choke" air flow through the air-and-fuel mixing passage.

In another example, some carburetors have startup systems that provide supplementary fuel when cranking a cold engine by opening a "start fuel" or supplementary fuel supply passage provided separately from a primary fuel supply passage. Such startup systems typically stop the supply of the supplementary fuel once the engine has been successfully started.

SUMMARY OF THE INVENTION

A method according to one implementation includes controlling supply of supplementary fuel through a supplementary fuel supply passage in a carburetor for an engine. An electromechanical valve is provided in fluid communication with the supplementary fuel supply passage. The electromechanical valve is powered as engine intake vacuum peaks.

According to another implementation, a system supplies supplementary fuel through a carburetor to an engine, and includes a supplementary fuel supply passage between a carburetor fuel chamber and a carburetor air-and-fuel mixing passage, and an electromechanical valve normally closing the passage. The system also includes a magneto device including a flywheel with a magnet group and a lamstack having a first leg carrying a coil, wherein the flywheel magnet group and the lamstack first leg are configured such that the electromechanical valve is powered to open the passage by current created by the magnet group rotating past the lamstack first leg as engine intake vacuum peaks.

According to a further implementation, a combustion engine includes an engine block defining a cylinder, and intake and exhaust passages in fluid communication with the cylinder, a crankshaft rotatably carried by the engine block, and a piston disposed in the cylinder and coupled to the crankshaft for translation within the cylinder to open and close the intake and exhaust passages. The engine also includes a carburetor including a fuel chamber, an air-and-fuel mixing passage in fluid communication with the intake passage, a primary fuel supply passage between the fuel chamber and the air-and-fuel mixing passage, a supplementary fuel supply passage between the fuel chamber and the air-and-fuel mixing passage, and an electromechanical valve normally closing the supplementary fuel supply passage. The engine further includes a magneto device including a flywheel coupled to the crankshaft, a magnet group carried by the flywheel, a lamstack including a first leg carrying a coil to power the electromechanical valve with current to open the supplementary fuel supply passage by the magnet group rotating past the lamstack first leg as vacuum peaks through the intake passage of the engine block.

According to yet another implementation, a carburetor includes a body defining an air and fuel mixing passage and carrying a throttle valve disposed in the mixing passage, the body also defining a main fuel supply passage in fluid communication with the mixing passage at a location upstream of the throttle valve and a supplementary fuel supply passage in fluid communication with the mixing passage at a location downstream of the throttle valve. The carburetor also includes a fuel metering assembly carried by the body and including a cover coupled to the body and a diaphragm disposed between the cover and the body and partially defining a fuel metering chamber, wherein the cover includes a first passage in fluid communication with the fuel metering chamber, a second passage in fluid communication with the supplementary fuel supply passage, and a valve seat therebetween. The carburetor further includes an electromechanical valve carried by the cover and including a valve in a normally closed position against the valve seat of the cover of the fuel metering assembly.

According to an additional implementation, a cover for a metering chamber of a carburetor having an air-and-fuel mixing passage includes a generally planar portion arranged to be coupled to a body of the carburetor, and a flange extending generally transversely from the generally planar portion and including at least a portion of a supplementary fuel supply passage.

According to still another implementation, there is provided a method of controlling supply of supplementary fuel through a supplementary fuel supply passage in a carburetor for an engine. The method includes supplying supplementary fuel during engine cranking, and further supplying supplementary fuel after engine cranking and during engine warmup until engine temperature meets engine temperature criteria and engine speed meets engine speed criteria.

According to a further implementation, there is provided a system to supply supplementary fuel through a carburetor to an engine. The system includes a supplementary fuel supply passage between a carburetor fuel chamber and a carburetor air-and-fuel mixing passage. The system also includes an electromechanical valve normally closing the passage and powerable to open the passage by current created in a valve power coil by a magnet group rotating past a lamstack leg around which the valve power coil is wound. The system further includes a power and control module including a thermal switch to cut off supply of current to the electromechanical valve when engine temperature exceeds a high temperature value.

BRIEF DESCRIPTION OF THE DRAWINGS

The following detailed description of exemplary embodiments and best mode will be set forth with reference to the accompanying drawings, in which.

DETAILED DESCRIPTION

Figure 1:
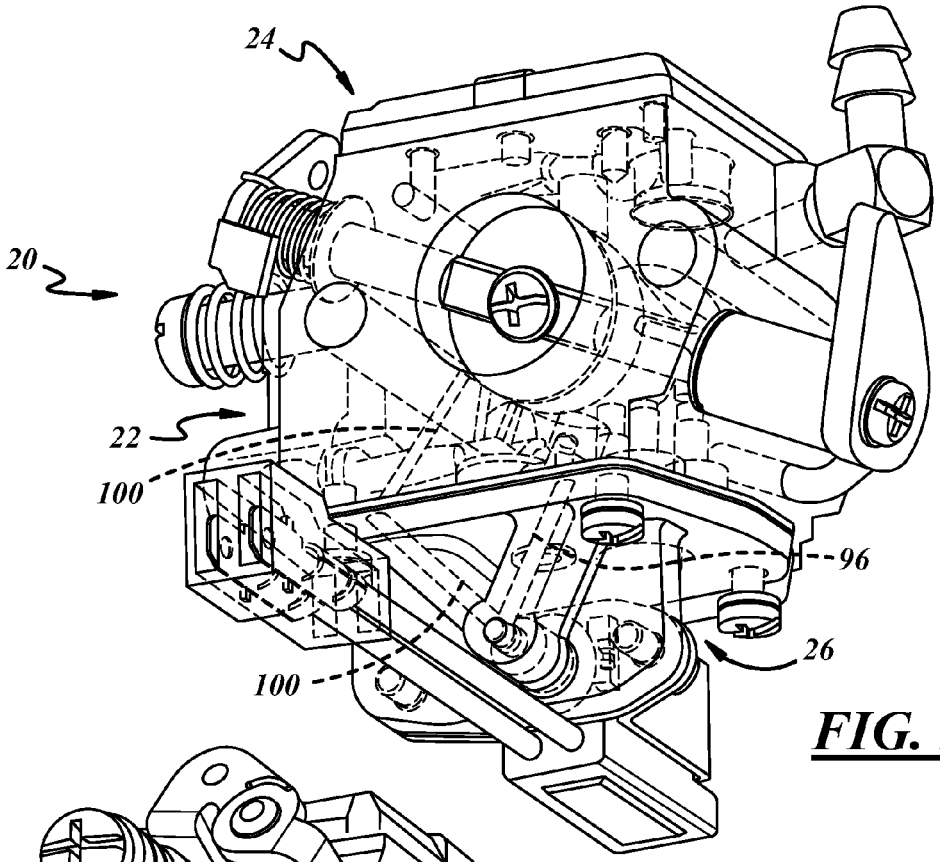
FIG. 1 is a perspective view of a presently preferred form of a carburetor.
Figure 2:
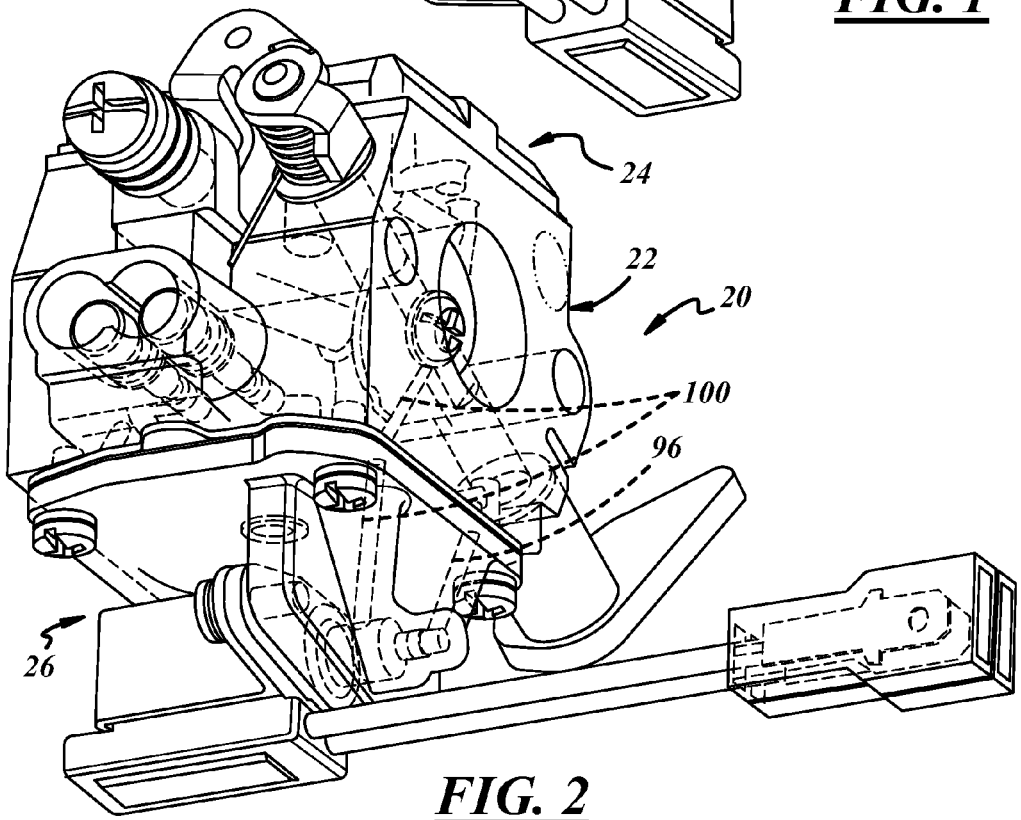
FIG. 2 is another perspective view of the carburetor of FIG. 1.
Figure 3:
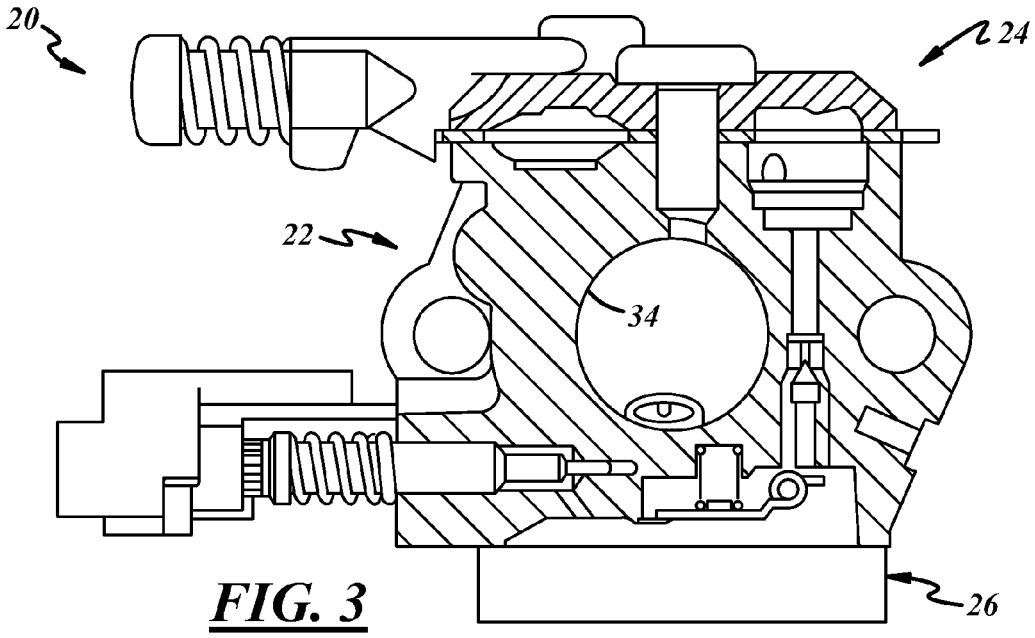
FIG. 3 is a cross-sectional view of the carburetor of FIG. 1.

Referring in more detail to the drawings, FIGS. 1 through 3 illustrate a carburetor 20 that may be used to provide a combustible charge of an air and fuel mixture to an engine (not shown). For example, the engine may be any suitable two-stroke engine, which may include a single cylinder engine with up to about 75 cc displacement for hand-held equipment such as hedge trimmers, grass trimmers, and chainsaws.

But whatever the application, the carburetor 20 generally may include a main body 22, a fuel pump assembly 24 for pumping liquid fuel, and a fuel metering assembly 26 for metering desired amounts of liquid fuel into the main body 22. The carburetor 20 may be similar in many respects to that described in U.S. Pat. No. 6,293,524, which is assigned to the assignee hereof and is incorporated by reference herein in its entirety.

The main body 22 may be composed of any suitable material, for example, of cast aluminum or the like. The main body 22 provides structural support for the aforementioned assemblies 24, 26 and various other components and passages as will be described in further detail herein below. Externally, the main body 22 may carry a fuel inlet fitting 30 for connection to a fuel tank (not shown), and may also carry a fuel outlet fitting (not shown) for discharging purged fuel and any fuel vapor and air and returning them to the tank.

Figure 4:
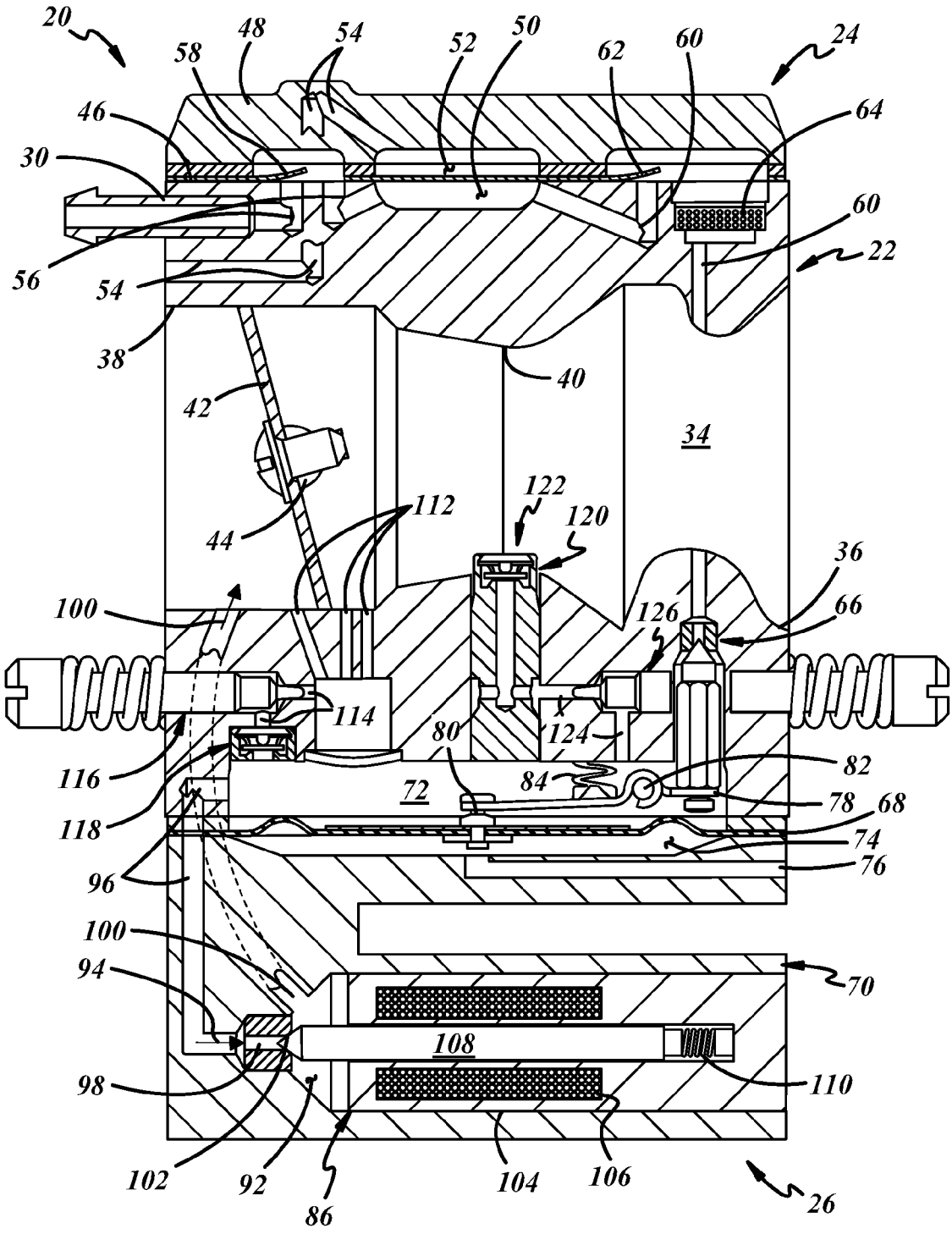
FIG. 4 is a fragmentary, sectional, schematic view of a portion of the carburetor of FIG. 1.

Internally, and referring now to FIG. 4, the main body 22 has an air and fuel mixing passage 34 with an air inlet 36 that may be in communication with an atmospheric air source such as an air filter (not shown) and an air and fuel mixture outlet 38 that may be in communication with an intake passage of the engine (not shown). The air and fuel mixing passage 34 may include a venturi 40 downstream of the inlet 36 and upstream of the outlet 38. A throttle valve 42 is received in the mixing passage downstream of the venturi 40 and is mounted on a throttle shaft 44 extending transversely through the passage 44 and journalled for rotation in the main body 22.

As shown in FIG. 4, the fuel pump assembly 24 has a flexible membrane or diaphragm 46 received and sealed between an upper face of the main body 22 and a lower face of an upper cover 48. The diaphragm 46 defines part of a pump chamber 50, and part of a pulse chamber 52 to which pressure and vacuum pulses in a crankcase of the operating engine (not shown) are introduced through a pulse passage 54 (shown fragmented) to flex or actuate the diaphragm 46.

The pump assembly 24 may use vacuum and pressure pulses from an engine crankcase to move the diaphragm 46 back and forth. Flexing of the diaphragm 46 toward the pulse chamber 52 expands the volume of the pump chamber 50 to create a vacuum therein to draw liquid fuel from a fuel tank (not shown) through the fitting 30, a fuel inlet passage 56 including a one-way check valve 58 therein, and into the pump chamber 50. In contrast, flexing of the diaphragm 46 toward the pump chamber 50 compresses the volume of the chamber 50 to pressurize the liquid fuel for delivery from the pump chamber 50 through a fuel outlet passage 60 including a one-way check valve 62 and a screen 64 therein, to the fuel metering assembly 26. The check valves 58, 62 may be integral portions of the diaphragm 46.

As shown in FIG. 4, at the bottom of the carburetor 20, the fuel metering assembly 26 has a flexible membrane or metering diaphragm 68 received and sealed between a lower face of the main body 22 and a cover 70. The metering diaphragm 68 defines part of a fuel metering chamber 72 on one side of the metering diaphragm 68 and an atmospheric air chamber 74 on its other side. The air chamber 74 communicates with the atmosphere outside of the carburetor 20 through a passage 76 in the cover 70. A metering valve 66 is opened and closed to control the admission of fuel to the fuel metering chamber 72 by movement of the metering diaphragm 68. The metering diaphragm 68 is operably connected to the metering valve 66 by a lever 78. The lever 78 is coupled at one end to the metering valve 66 and at another end cooperatively coupled to a projection 80 attached to the center of the metering diaphragm 68 and between its ends the lever 78 is pivotally mounted on a support shaft 82. The metering valve 66 is yieldably biased to its closed position by a spring 84 bearing on the lever 78.

The force of the metering spring 84 against the metering lever 78 holds the metering valve 66 against its seat and prevents fuel from entering the metering chamber 72. The metering diaphragm 68 may be composed of a flexible convoluted material to allow for sufficient movement. As the engine runs, fuel is drawn from the metering chamber 72 into the carburetor mixing passage 34. This causes the metering diaphragm 68 to advance and contact the metering lever 78. The pressure of the metering diaphragm 68 against the lever 78 overrides the force imposed by the spring 84 on the metering valve 66. The fuel pressure from the pump chamber 50 is then great enough to overcome the spring pressure on the metering valve 66 and fuel flows into the metering chamber 72.

Figure 5:
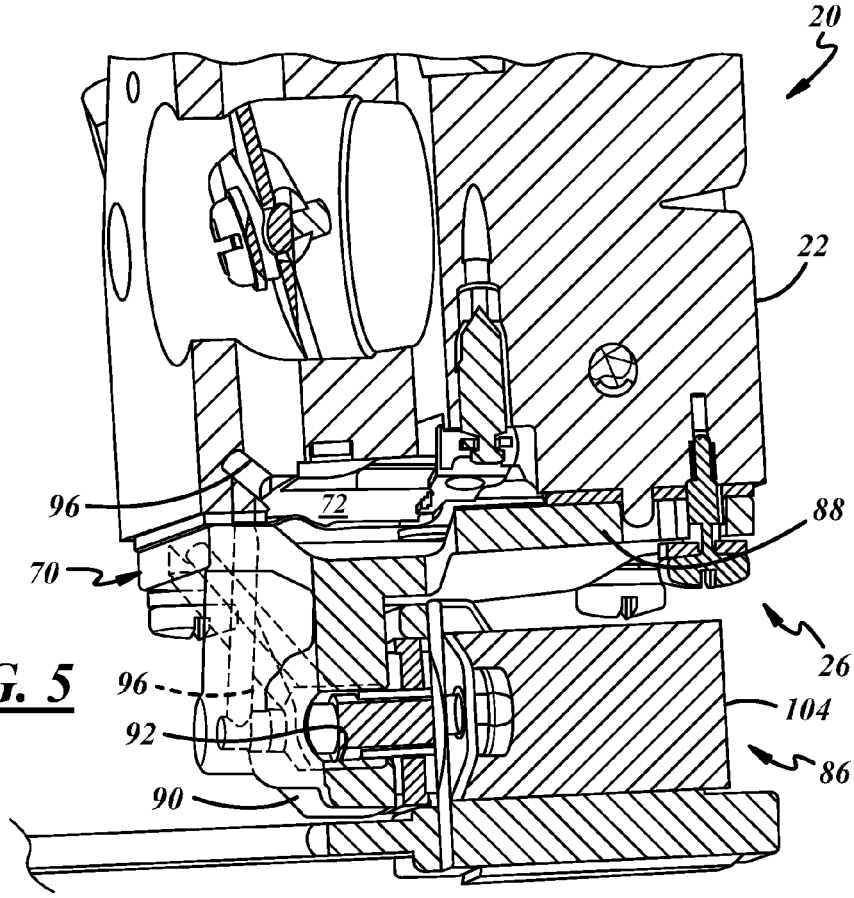
FIG. 5 is a fragmentary, sectional view of the carburetor of FIG. 1.

Referring to FIG. 5, the metering assembly 26 also includes a supplementary fuel supply assembly, which includes the cover 70 and an electromechanical valve 86 coupled in fluid communication to the cover 70. The cover 70 may be constructed in any suitable manner and composed of any suitable material. For example, the cover 70 may be cast from aluminum. The cover 70 includes a generally planar portion 88 coupled in any suitable manner to the carburetor body 22, and a flange 90 extending generally transversely from the generally planar portion 88. The flange 90 includes a supplementary fuel supply passage 92, which may include a first portion 94 in fluid communication with a valve inlet passage 96 that extends through a portion of the flange 90 and is in fluid communication with the metering chamber 72. The supplementary fuel supply passage 92 may also include a second portion 98 in fluid communication with a valve outlet passage 100 that extends through a portion of the flange 90 and is in fluid communication with the air and fuel mixing passage 34 of the carburetor 20. A valve seat 102 may be located between the first and second portions 94, 98.

The electromechanical valve 86 includes a housing 104 that may be coupled to the flange portion 90 of the cover 70 in any suitable manner, a coil 106 disposed in the housing 104, and a valve member 108 operatively coupled to the coil 106 and slidingly disposed in the passage 92 of the cover 70 to a normally closed position wherein a forward portion of the valve member 108 seats against the valve seat 102. A spring 108 may be disposed, for example, between a rearward end of the valve member 108 and a corresponding portion of the housing 104 to bias the valve member 108 toward the seat 102. The valve 86 is operable to open and close fluid communication between the inlet and outlet passages 96, 100 of the cover 70 to initiate supply and terminate supply of supplementary fuel through the supplementary fuel supply passage 92 in the carburetor main body. The valve 86 may be a carburetor solenoid, which is generally known to those of ordinary skill in the art, and the description and drawings of the solenoid described in U.S. Pat. No. 7,264,230 is hereby incorporated by reference herein. In other embodiments, the valve 86 may be any suitable device to allow, block, or otherwise control flow of fluid. For example, the valve 86 may include solenoid devices, servo devices, piezoelectric devices, or any other device suitable for use in a carburetor.

In addition to the supplementary fuel supply apparatus and path, those of ordinary skill in the art will recognize that a low speed fuel supply apparatus and path may also be used. For example, one or more low speed fuel passages 112 may open into the mixing passage 34 upstream and/or downstream of the throttle valve 44, for example when the valve 44 is in its idle or closed positions. The low speed fuel may be supplied from the metering chamber 72 via a branch passage 114 in communication with the port(s) 112, via an adjustable low speed fuel regulating needle valve 116 and a check valve 118.

Moreover, when the supplementary fuel supply apparatus is not used to supply fuel, such as when the throttle valve 44 is opened, liquid fuel may be supplied from the fuel metering chamber 72 through a primary fuel supply apparatus and path. The primary fuel supply apparatus may include a high speed fuel nozzle 120 carried by the body 26 and opening into the mixing passage 34, a check valve 122 carried by the nozzle 120, and a branch passage 124 via an adjustable fuel regulating needle valve 126.

Figure 6:
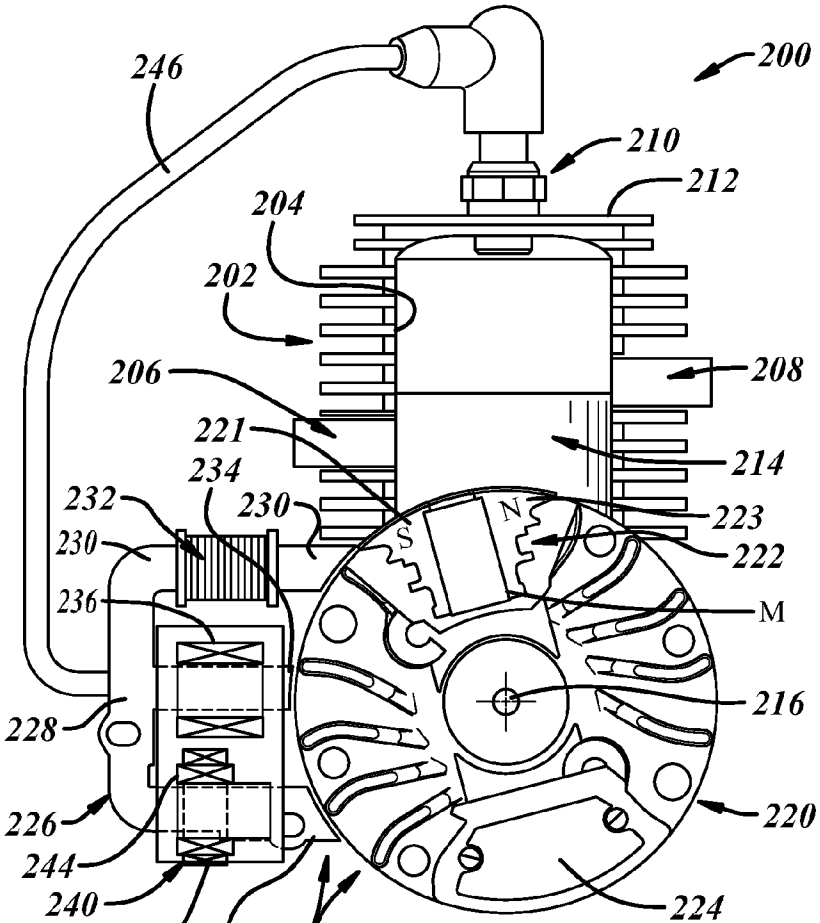
FIG. 6 is a partial schematic view of a presently preferred form of an engine, illustrating a closed intake passage position of a piston and a magneto device.

Referring now to FIG. 6, an engine 200 includes a cylinder block 202 defining a cylinder 204, and an intake port or passage 206 and an exhaust port or passage 208 in fluid communication with the cylinder 204. The engine 200 also includes a spark plug 210 coupled through a cylinder head 212 and being disposed partly within the cylinder 204. The engine 200 further includes a piston 214 disposed in the cylinder 204 and coupled to a crankshaft 216 for translation in the cylinder 204 to open and close the intake and exhaust passages 206, 208. The crankshaft 216 may be rotatably carried by the engine block 202.

The engine 200 additionally may include a power and control module (PCM) 218. The PCM 218 may be a multifunctional device, for example, to power the electromechanical valve 86 of the carburetor 20, to produce engine ignition spark to ignite the combustible charge, and/or to control at least some functionality of at least the carburetor 20. The PCM 218 may include a magneto device that may include a flywheel 220 coupled to the crankshaft 216 and carrying a magnet group 222 and an oppositely disposed counterweight 224. The magnet group 222 may include poles 221, 223 and a permanent magnet M disposed therebetween.

The PCM 218 may further include a lamstack 226 disposed adjacent the periphery of the flywheel 220. The lamstack 226 may be a ferromagnetic part comprised of a stack of flat, magnetically-permeable, laminate pieces typically composed of steel or iron. The lamstack 226 may have a generally E-shaped configuration that includes a base 228 and a trio of legs extending from the base 228. The trio includes a first leg 230 carrying an auxiliary or valve power coil 232 to power the electromechanical valve 86 of the carburetor 20, a second leg 234 carrying a charge coil 236 for charging an ignition capacitor and/or an electronic processing device if desired, and a third leg 238 carrying a transformer 240 including a pair of closely-coupled windings 242 and 244 to create high voltage ignition pulses that are sent to the spark plug 210 via an ignition lead 246 for developing spark energy to initiate combustion.

The PCM 218 may also provide an engine crankshaft angular position and/or speed signal for use by the control module using hall-effect sensors (not shown) located in the PCM 218 and triggered by the rotating flywheel magnets in proximity to the PCM 218. In other words, crankshaft position may be observed using the hall-effect sensors or by observation of charge coil voltages induced from the rotating flywheel magnet(s) instead of or in addition to a separate crankshaft position sensor. Such signals may be used in determining engine speed and/or other engine timing.

The PCM may provide the required power for the valve 86 and any sensors, in addition to its own internal power needs. For example, in FIG. 6, the engine 200 is illustrated in a compression stroke wherein the piston 214 is moving toward the cylinder head 212 such that the intake passage 206 is closed and the exhaust passage 208 is partially open but being closed. Reciprocation of the piston 214 causes the crankshaft 216 to rotate and, thus, the flywheel 220 is rotating counterclockwise such that the magnet group 222 is approaching the first leg 230 of the lamstack 226. As the flywheel 220 rotates and the magnet group 222 passes by the lamstack legs 230, 234, 238, an electric current is induced in the corresponding coils 232, 236, 242, 244. More particularly, the valve power coil 232 is positioned so that the magnet group 222 is generally aligned with the corresponding lamstack leg 230 in synchronization with a maximum or peak vacuum through the intake passage 206. Accordingly, the valve 86 can be opened in synchronism with the timing of supplying the air-and-fuel mixture into the intake passage 206 and, thus, no battery for powering the valve 86 is required. Those of ordinary skill in the art will recognize that engine intake vacuum is synonymous with a maximum negative pressure below atmospheric pressure in the engine intake, or a greatest sub-atmospheric pressure in the engine intake, or a minimum absolute pressure in the engine intake.

Figure 11:
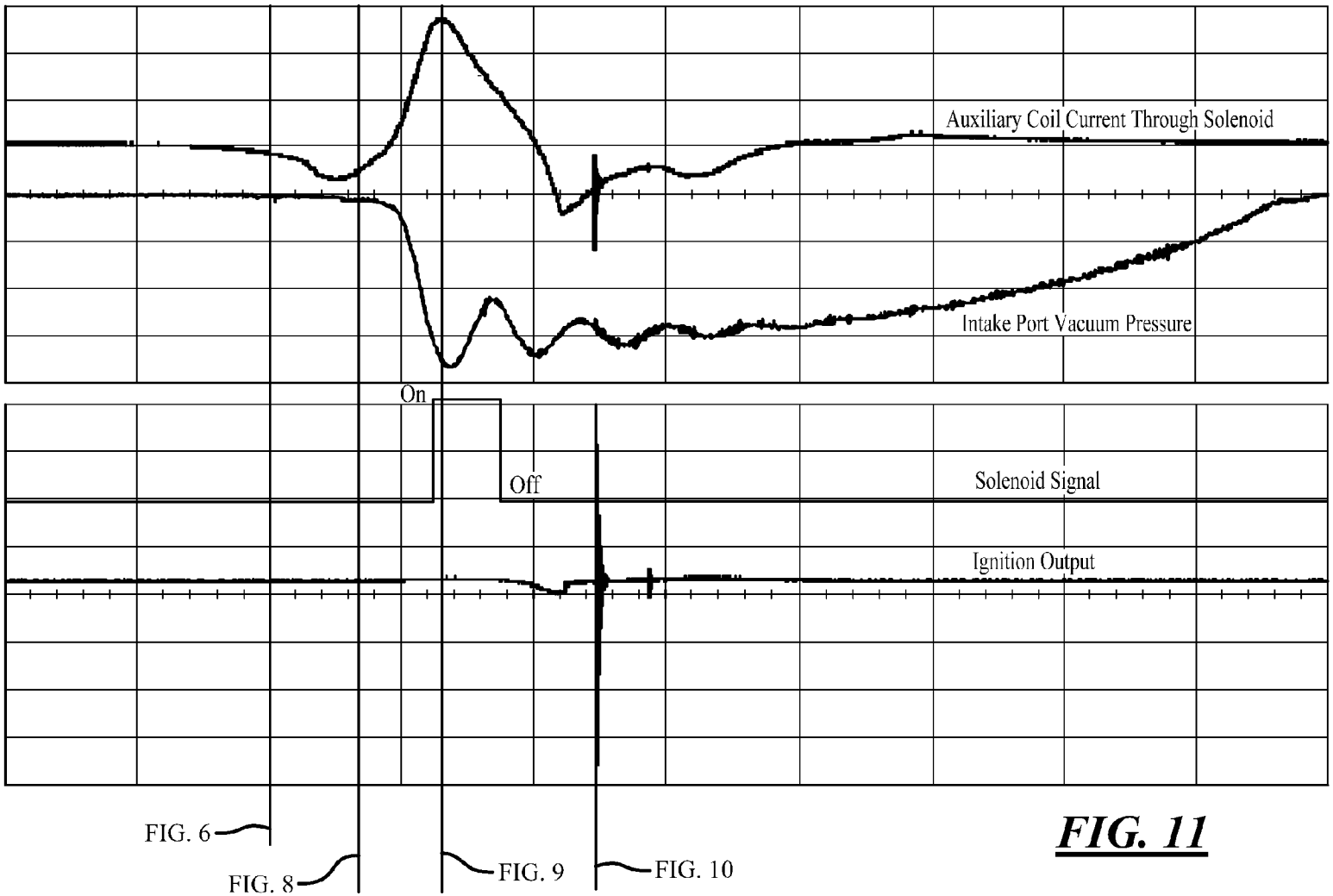
FIG. 11 is a graphical plot of electromechanical valve current, intake passage vacuum, electromechanical valve control signal, and ignition spark.

FIG. 11 illustrates plots of current through the electromechanical valve 86, vacuum through the intake passage 206, an electromechanical valve control signal, and ignition spark. The position of the piston and flywheel of FIG. 6 approximately corresponds to the FIG. 6 line in FIG. 11, wherein electromechanical valve current just begins to fluctuate due to the magnetic flux induced in the coil 232 by the approaching the first pole 221 of the magnet 222 group nearing the lamstack leg 230.

Figure 7:
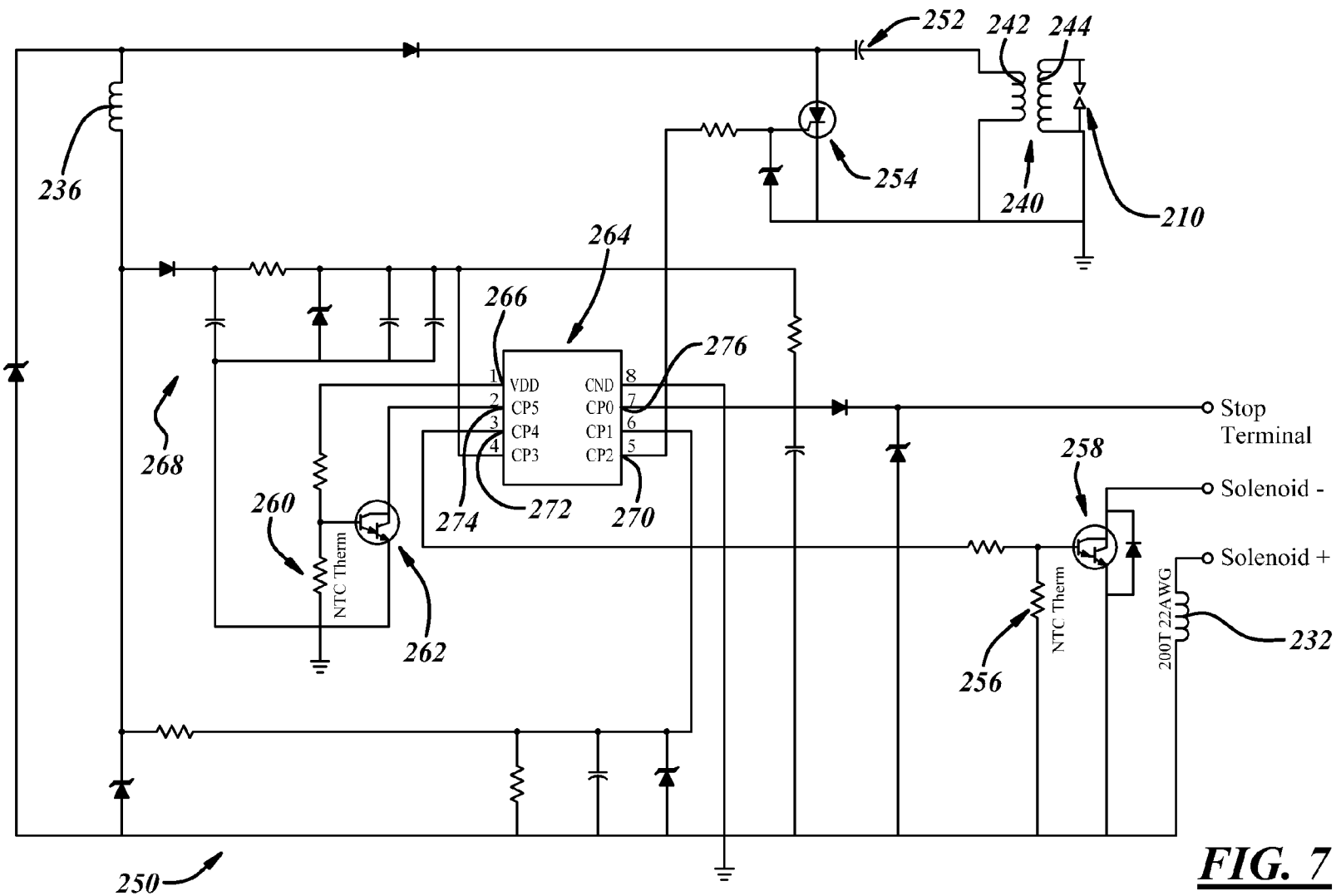
FIG. 7 is a schematic circuit diagram for control of ignition and supplementary fuel supply.

Turning now to FIG. 7, there is shown a schematic circuit diagram illustrating exemplary components of the PCM 218, including the valve power coil 232, the charge coil 236, the transformer 242, and a control circuit 250. It should be understood that numerous changes, including the addition, omission and/or substitution of various electrical components, could be made to this diagram as it is merely intended to provide a general overview of one possible implementation. The control circuit 250 may be implemented on a printed circuit board (PCB) or other circuit medium known to skilled artisans, and may be potted or otherwise hermetically sealed within a housing.

The control circuit 250 may use a number of different electrical components including, in this embodiment, an ignition capacitor 252, and a switching device 254 to discharge the ignition capacitor 252 for spark generation. The circuit 250 may also include a first thermal switch that may include a thermistor 256 and a transistor 258 to interrupt current flow to the valve 86 so as to terminate supplementary fuel supply when engine temperature exceeds a certain value, for instance, a high temperature value. Similarly, the circuit 250 may further include a second thermal switch that may include a thermistor 260 and a transistor 262 to initiate or continue current flow to the valve 86 so as to ensure supplementary fuel supply when engine temperature falls below another certain value, for instance, a low temperature value.

Accordingly, in the exemplary embodiment, supplementary or enrichment fuel supply may be varied by employing the thermal switches, which represent high and low temperature values or setpoints. Other embodiments may include employing a microprocessor, which can include an analog-to-digital converter for sensing actual temperature with a thermistor, converting a signal received from the thermistor to a temperature value, and cross-referencing the converted temperature value with electromechanical valve opening durations stored in memory. A cross-referenced valve opening duration corresponding to the actual temperature can then be used in powering the electromechanical valve. This latter embodiment permits use of more than two temperature setpoints for use in varying supplementary fuel supply, over an entire engine temperature range.

The transistors 258, 260 may include solid state devices, for example, pairs of high voltage bipolar transistors connected in a Darlington arrangement for high current gain. The switching device 254 may be a high current solid state switching device, such as a silicon controlled rectifier (SCR) or some other type of thyristor, and may be designed to discharge the ignition capacitor 252. In this embodiment, the switching device 252 is part of an energy discharge path that also includes the primary winding 244, the ignition capacitor 252, and ground.

The ignition circuit also includes an electronic processing device 264 that may execute various electronic instructions pertaining to a variety of tasks, such as ignition timing control, valve control, etc. The electronic processing device 264 may be a microcontroller, a microprocessor, an application specific integrated circuit (ASIC), or any other suitable type of analog or digital processing device known in the art. In the illustrated embodiment, the electronic processing device 264 is a microcontroller to process and store data and/or information like electronic instructions and variables. The processing device 264 may execute instructions that provide at least some of the functionality for the apparatus described herein. As used herein, the term instructions may include, for example, control logic, computer software and/or firmware, programmable instructions, or other suitable instructions.

Although not separately shown, any suitable memory device(s) may be coupled to the processing device 264 to provide storage for data, and/or for processor-executable instructions. The data and/or instructions may be stored, for example, as look-up tables, formulas, algorithms, maps, models, and/or any other suitable format. The memory may include, for example, RAM, ROM, EPROM, and/or any other suitable type of storage device.

The electronic processing device 264 may be powered at a power input 266 by the charge coil 236 via various electronic power conditioning components, including one or more capacitors 268 that smooth or otherwise regulate the energy induced in the charge coil 236. According to the embodiment shown here, the electronic processing device 264 may include an ignition signal output 270 for providing a discharge control signal to the ignition switch 254, a first thermal signal output 272 for providing a control signal to the transistor 258, and a second thermal signal input 274 for receiving a control signal from the second thermal switch. The device 264 may also include a stop input 276 coupled to an optional stop switch (not shown), which acts as a manual override for shutting down the engine 200. It should be appreciated that numerous circuit arrangements, including ones other than the exemplary arrangement shown here, could be used to process, condition, or otherwise improve the quality of signals used herein.

Figure 8:
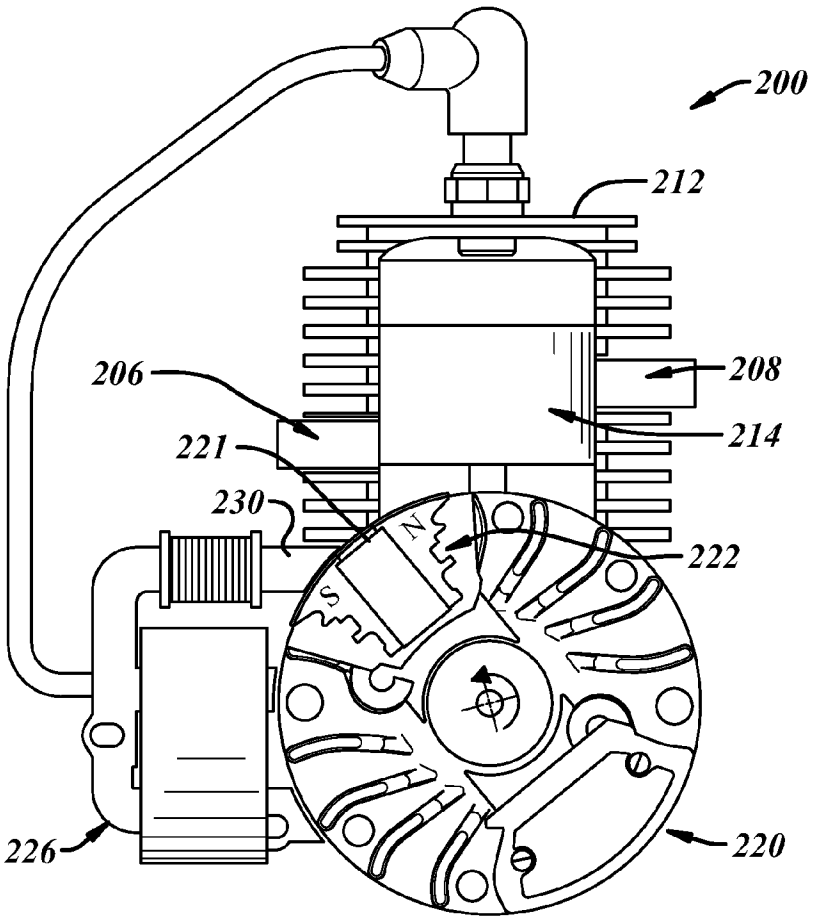
FIG. 8 is a partial schematic view of the engine of FIG. 6, illustrating an initially opened intake passage position of the piston and the magneto device.

Referring to FIG. 8, the piston 214 has moved further toward the cylinder head 212 such that the intake passage 206 is initially opened and the exhaust passage 208 is being further closed. Also, the flywheel 220 has continued to rotate counterclockwise such that the magnet group 222 overlaps the first leg 230 of the lamstack 226. The position of the piston 214 and flywheel 220 in FIG. 8 corresponds to approximately 59 degrees before top dead center (BTDC) of the piston 214. Also, the position of the piston 214 and flywheel 220 of FIG. 8 approximately corresponds to the FIG. 8 line in FIG. 11, wherein electromechanical valve current has started to reverse direction as the axis of the first pole 221 has just passed the axis of the first lamstack leg 230, and vacuum through the intake passage 206 is initiated due to the initial opening of the intake passage 206.

Figure 9:
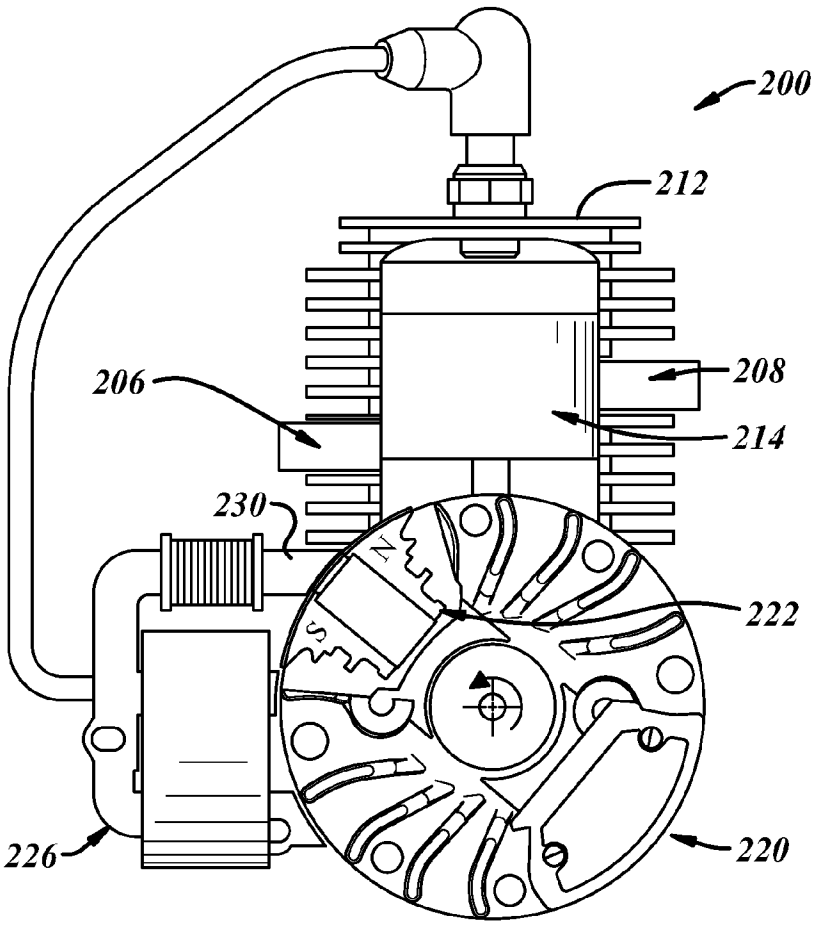
FIG. 9 is a partial schematic view of the engine of FIG. 6, illustrating a peak intake passage vacuum condition of the piston and the magneto device.

Referring to FIG. 9, the piston 214 has moved even further toward the cylinder head 212 such that the exhaust passage 208 is now closed and the intake passage 206 is now opened to the point at which vacuum through the intake passage 206 is substantially at a maximum. Also, the flywheel 220 has further continued to rotate counterclockwise such that the magnet group 222 is generally aligned with the first leg 230 of the lamstack 226.

The valve power coil 232 and the flywheel magnet group 222 are arranged in relation to the position of the piston 214 where vacuum through the intake passage 206 peaks. For example, the electromechanical valve 86 is powered within about 80% of peak engine intake vacuum and, more particularly may be powered within about 90% of peak engine intake vacuum. In another example, the electromechanical valve 86 opens when the intake passage 206 reaches an opening amount of about 10% to 20% of full opening and, more particularly about 15% to 16% of full opening. In a further example, the position of the piston 214 and flywheel 220 in FIG. 9 corresponds to about 40 to 60 degrees BTDC of the piston 214 and, more particularly about 51 degrees BTDC of the piston 214.

As shown in FIG. 11, the position of the piston 214 and flywheel 220 of FIG. 9 approximately corresponds to the FIG. 9 line in FIG. 11, wherein electromechanical valve current reaches a level sufficient to power the valve 86 as the magnet M approximately aligns with the axis of the first lamstack leg 230, and vacuum through the intake passage 206 begins to peak. As also shown in FIG. 11, the electromechanical valve control signal has changed state substantially in correspondence with the electromechanical valve current. About 65% to 75% of peak current produced by the valve power coil 232 for the valve 86 and, more particularly about 70% of peak current, is initially used to open the valve 86 and corresponds to about 380 mA in the exemplary embodiment disclosed herein.

The degree to which the electromechanical valve 86 stays on is dependant on engine speed and may increase with cranking speed, but may stay on for a minimum of about 10 degrees of crank angle, and may be on for up to about 72 degrees of crank angle, which equates to about 40% of the 180 degrees of the compression stroke. In the exemplary engine environment disclosed herein, at about 1,500 RPM the valve power coil 232 reaches peak current output and can maintain the electromechanical valve 86 in an energized state for about 10 to 72 degrees of crank angle. The valve 86 may stay open until the current falls below, for example, about 50 mA.

Figure 10:
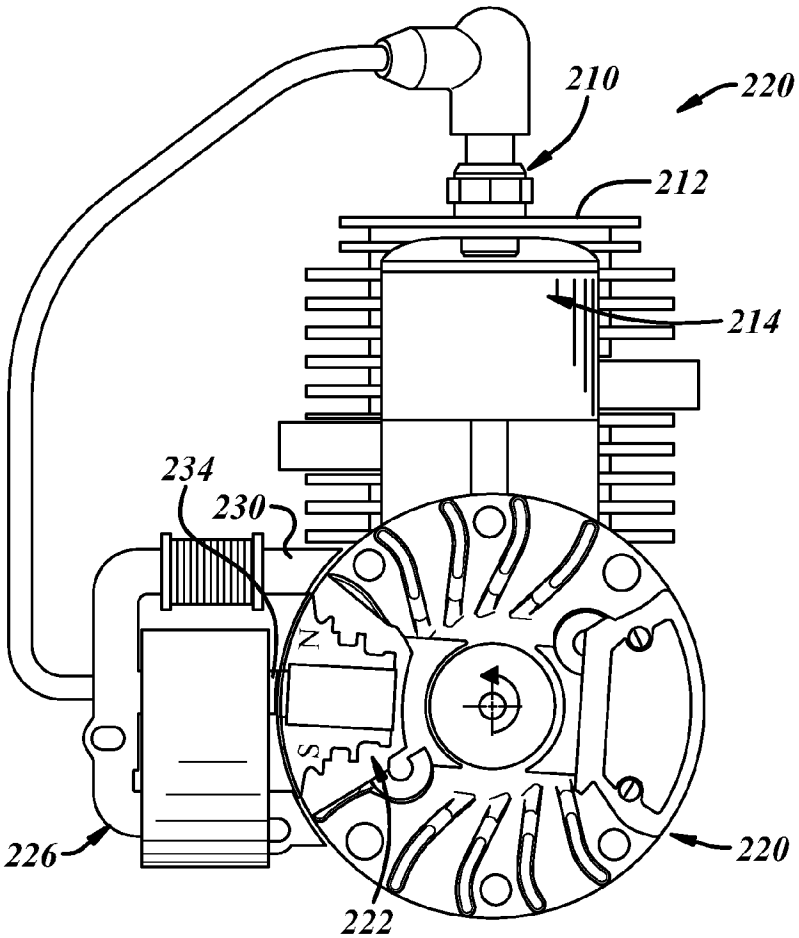
FIG. 10 is a partial schematic view of the engine of FIG. 6, illustrating a maximum opened intake passage position of the piston and the magneto device.

Referring to FIG. 10, the piston 214 has moved still further toward the cylinder head 212 such that the both the intake and exhaust passages 206, 208 are closed and the spark plug 210 fires to ignite the air-and-fuel mixture in the combustion chamber and force the piston 214 to reverse direction and move away from the cylinder head 212.

Timing of the firing of the spark plug 210 varies with engine RPM, is specified in terms of its relationship to piston top-dead-center (TDC), and can be delayed with respect to TDC. For example, spark plug firing may be delayed to about 6 to 24 degrees BTDC, which corresponds in the exemplary engine to about 35 to 53 degrees delay, for instance, after the intake passage opens or after vacuum through the intake passage 206 substantially reaches a maximum.

Also, the flywheel 220 has further rotated further counterclockwise such that the magnet group 222 is generally aligned with the second leg 234 of the lamstack 226. The position of the piston 214 and flywheel 220 in FIG. 10 corresponds to approximately 8 degrees BTDC of the piston 214. Also, the position of the piston 214 and flywheel 220 of FIG. 10 approximately corresponds to the FIG. 10 line in FIG. 11, wherein an ignition output current spikes when the spark plug 210 is fired.

Figure 12:
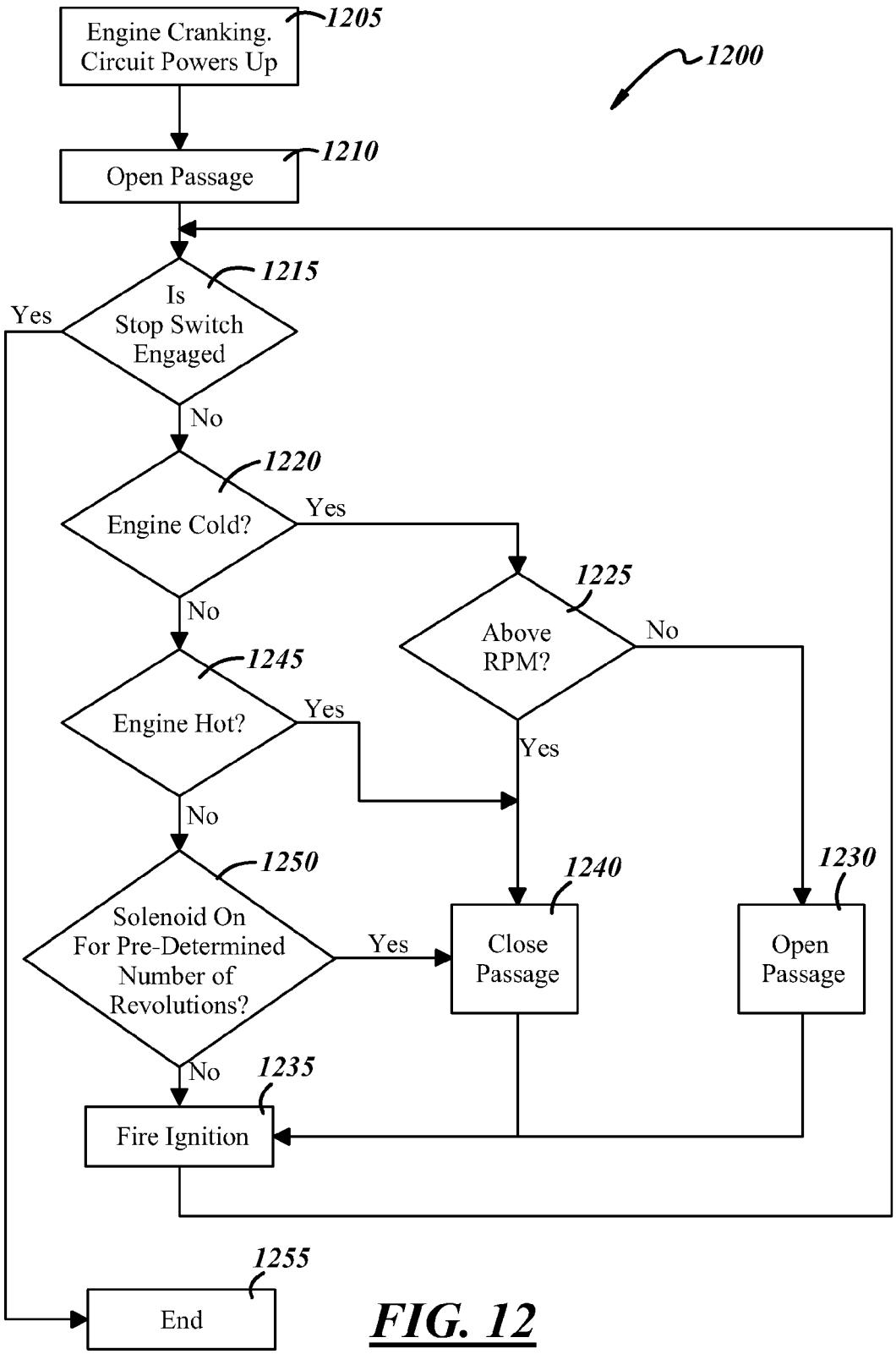
FIG. 12 is a flow chart of a presently preferred form of a method of controlling air and fuel supply to an engine.

FIG. 12 illustrates an exemplary method 1200 of controlling supply of supplementary fuel for an engine, as discussed in detail below. Also, portions of the method 1200 will be described in reference to FIGS. 1 through 11. The method steps may or may not be sequentially processed, and the invention encompasses any sequencing, overlap, or parallel processing of such steps.

At step 1205, the method 1200 may commence in any suitable manner. For example, the engine 200 may be cranked in an attempt to startup the engine 200 so that it runs on its own. More specifically, the engine 200 may be manually cranked such as by an operator pulling on a manual recoil starter (not separately shown). During engine cranking, the flywheel 220 rotates and the magnet group 222 and the lamstack cooperate to produce electrical power.

At step 1210, a supplementary fuel supply passage may be opened. For example, a valve may be powered. More specifically, electrical power may be communicated to the electromechanical valve 86 to unseat the valve member 108 and allow fuel to flow from the fuel chamber 72 to the air-and-fuel mixing passage 34.

At step 1215, it may be determined whether or not a stop switch is activated. If so, the method terminates at step 1255. If not, the method proceeds to step 1220.

At step 1220, it may be determined whether or not an engine temperature meets an engine temperature criteria. For example, the engine temperature criteria may be a first of two or more engine temperature criteria in the method 1200. The criteria may be a low or cold engine temperature criteria, for instance, an engine temperature range or threshold value, for example, of between about 30 to about 50 degrees Fahrenheit and, more particularly, about 40 degrees. Of course, such temperature values and ranges are engine application specific, vary with carburetor settings for the particular application, and may be determined during calibration of carburetor prototypes in thermal chamber testing. The determination may include sensing engine temperature, for instance, using thermal switches, temperature sensors, thermocouples, or any other suitable devices and associated equipment like processors, memory, and the like.

If the engine temperature does not meet the cold engine temperature criteria, then the method proceeds to step 1245. But if so, then the method branches to step 1225.

At step 1225, it may be determined whether or not an engine speed meets engine speed criteria. For example, the engine speed criteria may be low engine speed criteria, for instance, between about 1,000 and 2,000 RPM and, more particularly, may be about 1,700 RPM. The low speed criteria and ranges are engine application specific, and may be determined during carburetor calibration and may correspond to a lowest engine speed at which the engine idles smoothly. Engine speed may be determined in any suitable manner, for example, an engine speed sensor (not shown) may be operatively coupled to the crankshaft, the flywheel, or the like in any suitable manner, or one or more of the lamstack coils 232, 236, 242, 244 may be used to track engine revolutions in any suitable manner.

If engine speed does not meet the engine speed criteria, then the method proceeds to step 1230. Otherwise, the method proceeds to step 1240.

At step 1230, a supplementary fuel supply passage may be initially opened or maintained in an open state. For example, electrical power is communicated to the electromechanical valve 86 to unseat the valve member 108 and allow fuel to flow from the fuel chamber 72 to the air-and-fuel mixing passage 34. Thus, when the engine 200 is relatively cold, the electromechanical valve 86 is activated not only during cranking but also at any time engine speed falls below low speed criteria.

At step 1235, a spark plug may be fired. For example, the electronic processing device 264 may send an ignition signal to the switch 254 to fire the spark plug 210.

At step 1240, a supplementary fuel supply passage may be closed. For example, electrical power to the electromechanical valve 86 is terminated or kept off to seat the valve member 108 or keep it seated and prevent fuel from flowing from the fuel chamber 72 to the air-and-fuel mixing passage 34. In one embodiment, the electronic processing device 264 may cease output of the valve-on control signal. In another embodiment, the valve-on control signal from the electronic processing device 264 may be shorted to ground when the thermistor 256 conducts. After step 1240, the method loops back just before step 1215.

At step 1245, it may be determined whether or not an engine temperature meets additional engine temperature criteria. For example, the additional engine temperature criteria may be a warm or hot engine temperature, for instance, of about 75 to about 95 degrees Fahrenheit and, more particularly, about 85 degrees. Again, such temperature values and ranges are engine application specific, vary with carburetor settings for the particular application, and may be determined during carburetor calibration in a thermal chamber to correspond to a temperature at which the engine can be started and idle smoothly without additional enrichment from the electromechanical valve 86. The determination may include sensing engine temperature, for instance, using thermal switches, temperature sensors, thermocouples, or any other suitable devices and associated equipment like processors, memory, and the like.

If the engine temperature does not meet the additional engine temperature criteria, then the method proceeds to step 1250. But if so, then the method branches to step 1240, because a warm engine should not require supplementary fuel for startup. The A/F ratio of hot, running engine is generally leaner than the A/F ratio to reliably start a cold engine.

At step 1250, it may be determined whether or not a supplementary fuel supply passage has been open for more than a determined number of engine revolutions. Engine revolutions may be assessed in any suitable manner, for example, using any suitable counter with any suitable input such as that from an engine speed sensor, or one or more of the coils. The minimum number may be, for example, about 10 to 20 revolutions and, more specifically, about 15 revolutions. The number may be determined by engine testing as the maximum number of revolutions below the high temperature criteria that does not result in engine flooding.

In some cases an engine may fail to start quickly and, because the supplementary fuel supply passage may remain open, the start fuel may continue to be supplied to the engine 200, thereby potentially "flooding" the spark plug 210 in the combustion chamber of the engine 200 with an excessively rich mixture of air and fuel. Once the spark plug 210 becomes flooded, the engine 200 may be difficult or impossible to start, and the operator must wait until the fuel evaporates from the spark plug 210 before trying to start the engine 200 again.

If the supplementary fuel supply passage has been open for more than the determined number of engine revolutions, then the method may proceed to step 1240. Otherwise, the method proceeds to step 1235, whereafter the method may loop back to step 1215.

At step 1255, the method 1200 may terminate in any suitable manner. For example, the method terminates if the stop switch is engaged, if the engine revolutions are insufficient to power the circuit, and/or the like.

Figure 13A:
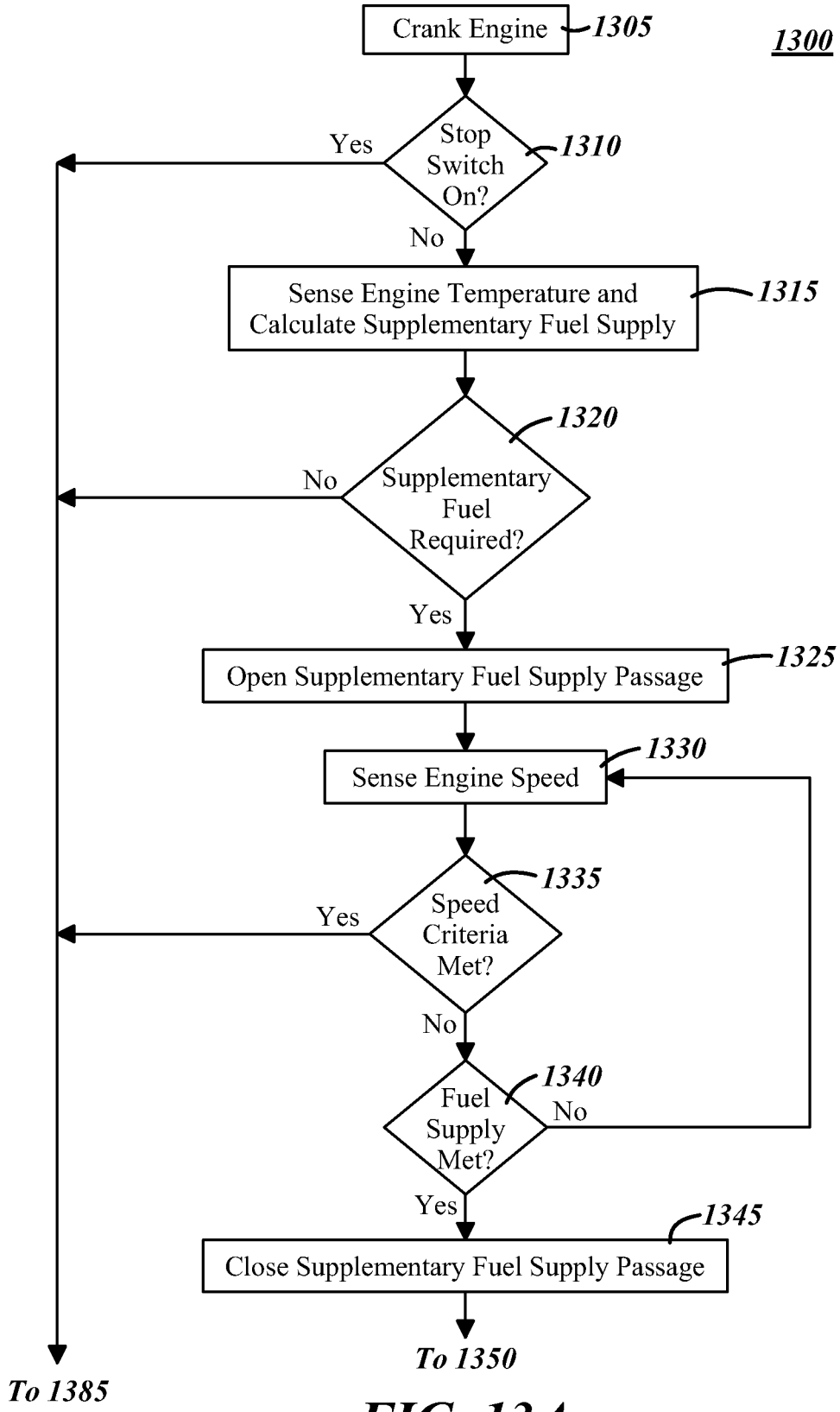
FIG. 13A is a portion of a flow chart of another presently preferred form of a method of controlling supply of supplementary fuel through a supplementary fuel supply passage in a carburetor for an engine.
Figure 13B:
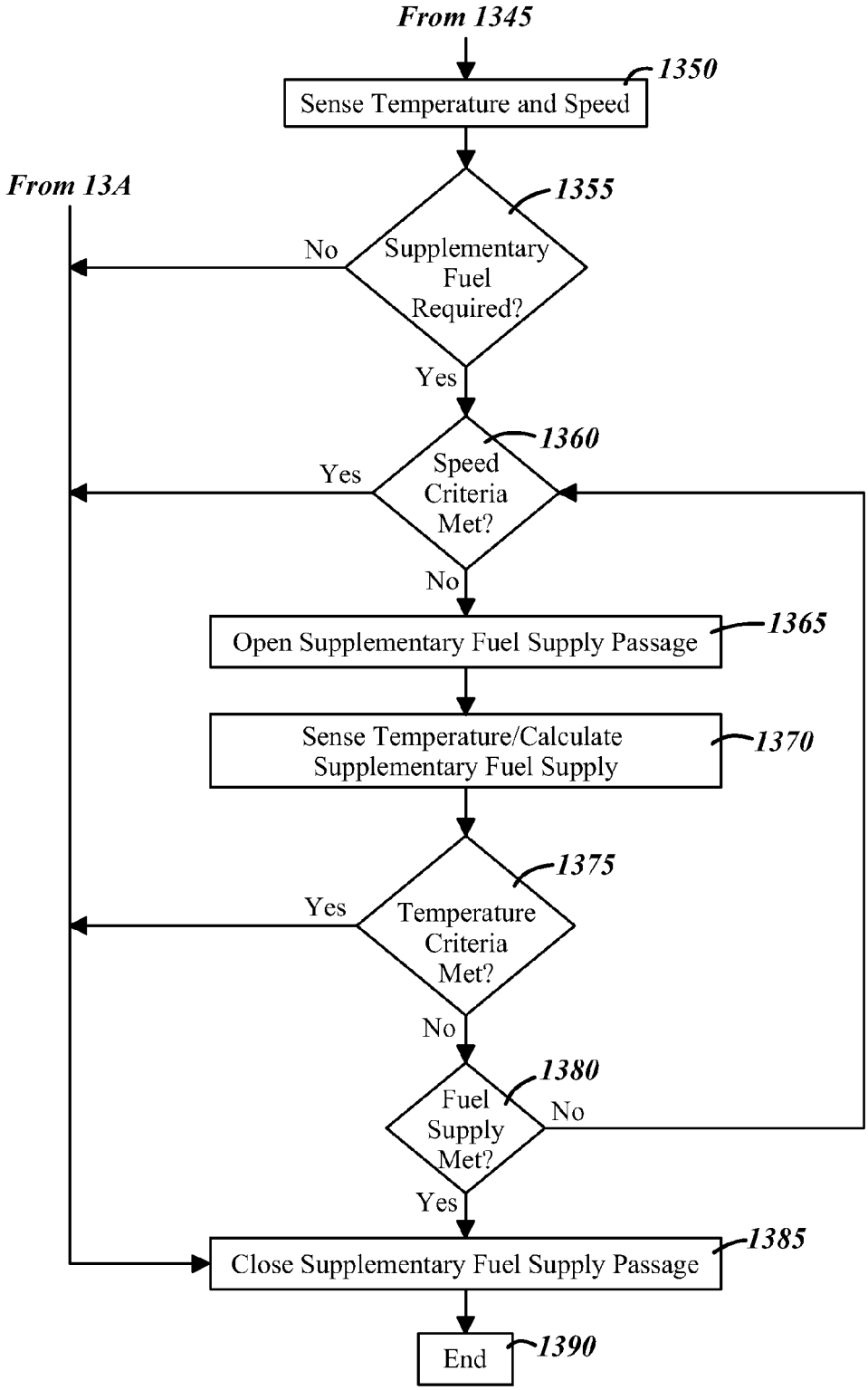
FIG. 13B is another portion of the flow chart of FIG. 13B.

FIGS. 13A and 13B illustrate another presently preferred form of a method 1300 of controlling supply of supplementary fuel for an engine. This form is similar in many respects to the form of FIG. 12 and like numerals between the forms generally designate like or corresponding steps throughout the several views of the drawing figures. Accordingly, the descriptions of the methods 1200 and 1300 are incorporated into one another by reference in their entireties. Additionally, the description of the common subject matter generally may not be repeated here.

FIGS. 13A and 13B illustrate an exemplary method 1300 of controlling supply of supplementary fuel for an engine, as discussed in detail below. Also, portions of the method 1300 will be described in reference to FIGS. 1 through 11. The method steps may or may not be sequentially processed, and the invention encompasses any sequencing, overlap, or parallel processing of such steps.

FIG. 13A illustrates a routine of the method 1300 for supplying supplementary fuel during engine cranking. FIG. 13B illustrates another routine of the method 1300 for further supplying supplementary fuel after engine cranking and during engine warmup.

Referring now to FIG. 13A, at step 1305, the method 1300 may commence in any suitable manner. For example, the engine 200 may be cranked in an attempt to startup the engine 200 so that it runs on its own. More specifically, the engine 200 may be manually cranked such as by an operator pulling on a manual recoil starter (not separately shown). During engine cranking, the flywheel 220 rotates and the magnet group 222 and the lamstack cooperate to produce electrical power.

At step 1310, it may be determined whether or not an engine stop switch is activated. If so, the method proceeds to step 1385. If not, the method proceeds to step 1315.

At step 1315, engine temperature may be sensed and a supply of supplementary fuel during engine cranking may be determined. For example, upon engine cranking and within about the first two to three revolutions of an engine crankshaft, engine temperature may be sensed, crankshaft revolutions may be counted, and a number of crankshaft revolutions remaining over an engine cranking cycle may be calculated. For example, an engine cranking cycle may include six revolutions. So, for instance, if two crankshaft revolutions have been counted by the time the engine temperature is sensed, then the supply of supplementary fuel is determined to be carried out over the next four crankshaft revolutions. This is because six cranking revolutions minus two counted revolutions equals four revolutions.

At step 1320, a determination is made whether or not supplementary fuel is required during engine cranking. For example, the engine temperature sensed in step 1315 may be used in a comparison with engine temperature criteria, for instance, a certain minimum engine startup temperature. In one example embodiment, if the sensed engine temperature does not meet the criteria, then the method proceeds to step 1325, otherwise the method proceeds to step 1385.

At step 1325, a supplementary fuel supply passage may be opened. For example, the electromechanical valve 86 may be powered.

At step 1330, engine speed may be determined. For example, an engine speed sensor may be used to sense engine speed, or lamstack coils and suitable circuitry may be used to determine engine speed, or the like. Using lamstack coils to count engine revolutions and circuitry to calculate engine speed as a function of revolutions per time is well known to those of ordinary skill in the art.

At step 1335, it may be determined whether or not engine speed meets engine speed criteria. For example, the engine speed may be that determined in step 1330, and the criteria may be a minimum engine speed startup criteria, for instance, between about 1,000 and 2,000 RPM and, more particularly, may be about 1,700 RPM. If the engine speed criteria is met, then the method proceeds to step 1340, otherwise, the method proceeds to step 1385.

At step 1340, it may be determined whether or not a determined amount of supplementary supply of fuel for engine cranking has been reached. For example, if a sixth revolution of engine cranking has been determined to have occurred, then it can be determined that the determined amount of supplementary supply of fuel determined in step 1315 has been reached. If not, then the method loops back to step 1330. But if so, then the method proceeds to step 1345.

At step 1345, a supplementary fuel supply passage may be closed. For example, the valve 86 may be depowered. Thereafter, the method proceeds to step 1350.

At step 1350, engine temperature and/or speed may be sensed in any suitable manner.

At step 1355, a determination is made whether or not further supplementary fuel is required after engine cranking and during an engine warmup period. For example, the engine temperature sensed in step 1350 may be used in a comparison with engine temperature criteria that may be the same as or different from that discussed in step 1320. If the sensed engine temperature meets the criteria, then the method proceeds to step 1360, otherwise the method proceeds to step 1385.

At step 1360, it may be determined whether or not engine speed meets engine speed criteria. For example, the engine speed may be that determined in step 1350, and the engine speed criteria may be the same as that or different from the engine speed criteria of step 1335. If the criteria is met, then the method proceeds to step 1365, otherwise, the method proceeds to step 1385.

At step 1365, a supplementary fuel supply passage may be opened. For example, the electromechanical valve 86 may be powered.

At step 1370, engine temperature may be sensed and a further supply of supplementary fuel during engine warmup may be determined. For example, after engine cranking and during an engine warmup period, engine temperature may be sensed, and a calculation can be made of warmup parameters such as a fuel supply duration or quantity of crankshaft revolutions, and a fuel supply cycle length or frequency of revolutions over which the further supply of supplementary fuel is desired.

The following examples are for illustration and not limitation. The frequency may be calculated to be, for instance, every sixth crankshaft revolution, and the quantity or duration may be calculated to be, for instance, one to four crankshaft revolutions over which the further supply of supplementary fuel is provided for every determined cycle length.

Such parameters may be calculated as a function of engine temperature and/or speed. For instance, supplementary fuel may be provided over a greater number of revolutions and more frequently for lower engine temperatures and/or speeds, and vice versa.

At step 1375, it may be determined whether or not engine temperature meets engine temperature criteria. For example, the engine temperature may be that sensed in step 1370 and the criteria may be same or different from that of step 1355. If the sensed engine temperature meets the criteria, then the method proceeds to step 1380, otherwise the method proceeds to step 1385.

At step 1380, it may be determined whether or not a determined amount of a further supply of supplementary fuel for engine warmup has been reached. For example, if the number of revolutions determined in step 1370 was four, and it has been determined that four revolutions have occurred since step 1370, then it can be determined that the amount of further supply of supplementary fuel determined in step 1370 has been reached. If not, then the method loops back to step 1360. But if so, then the method proceeds to step 1385.

At step 1385, a supplementary fuel supply passage may be closed. For example, the valve 86 may be depowered. Thereafter, the method proceeds to step 1390.

At step 1390, the method terminates in any suitable manner.

Figure 14:
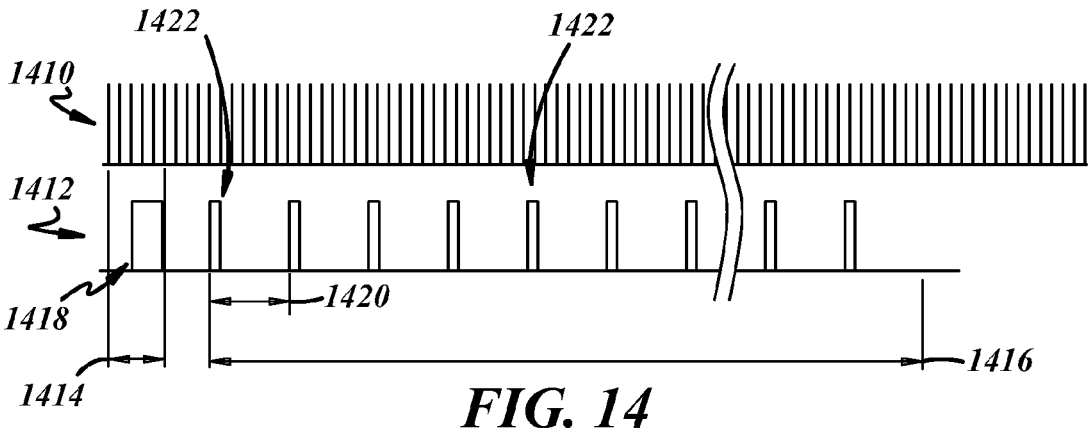
FIG. 14 is an example graphical representation of one example of the method of FIGS. 13A and 13B.

FIG. 14 illustrates an example graphical representation of one example of the method 1300 of FIGS. 13A and 13B. The graph includes a plurality of engine revolution pulses 1410, and a plurality of valve open pulses 1412. The graph also illustrates an engine cranking period 1414, and an engine warmup period 1416. A single valve open pulse 1418 is illustrated as occurring over the last four engine crankshaft revolutions of the cranking period 1414. A plurality of cycles 1420 may repeat over the engine warmup period 1416, and a plurality of valve open pulses 1422 are illustrated as occurring over the engine warmup period 1416.

In the routine illustrated in FIG. 13B and as illustrated in FIG. 14, supplementary fuel may be intermittently supplied, for example in a determined amount and frequency, so long as engine temperature does not meet engine temperature criteria and so long as engine speed does not meet engine speed criteria. Such intermittent supply of supplementary fuel may be carried out for no longer than an engine warmup period for any given engine start.

Figure 15:
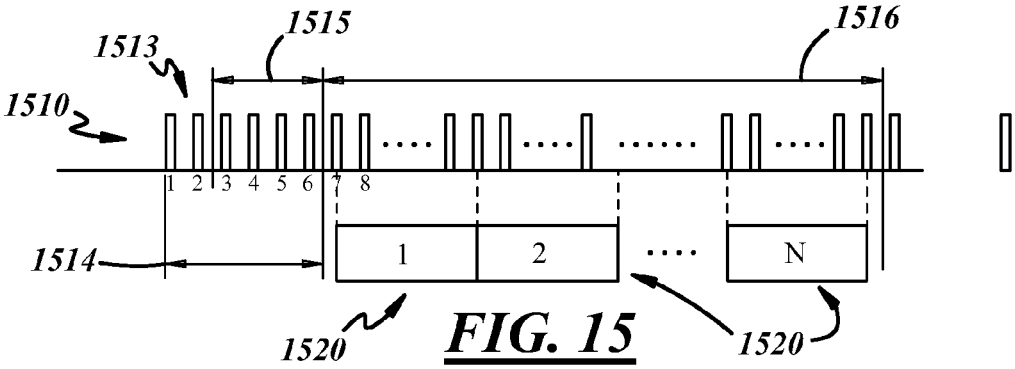
FIG. 15 is another example graphical representation of another example of the method of FIGS. 13A and 13B.

FIG. 15 illustrates another example graphical representation of another example of the method 1300 of FIGS. 13A and 13B. The graph includes a plurality of engine revolution pulses 1510, an engine cranking period 1514, and an engine warmup period 1516. The engine cranking period 1514 includes an initial phase 1513 over a first two engine revolutions and a supplementary fuel supply phase 1515 over a subsequent four engine revolutions. The engine warmup period 1516 includes N number of cycles 1520 over which the routine of method steps 1350 through 1385 of method 1300 of FIG. 13 may occur. For each of the cycles 1520, supplementary fuel may be supplied, for example, according to steps 1360 through 1380.

Figure 16:
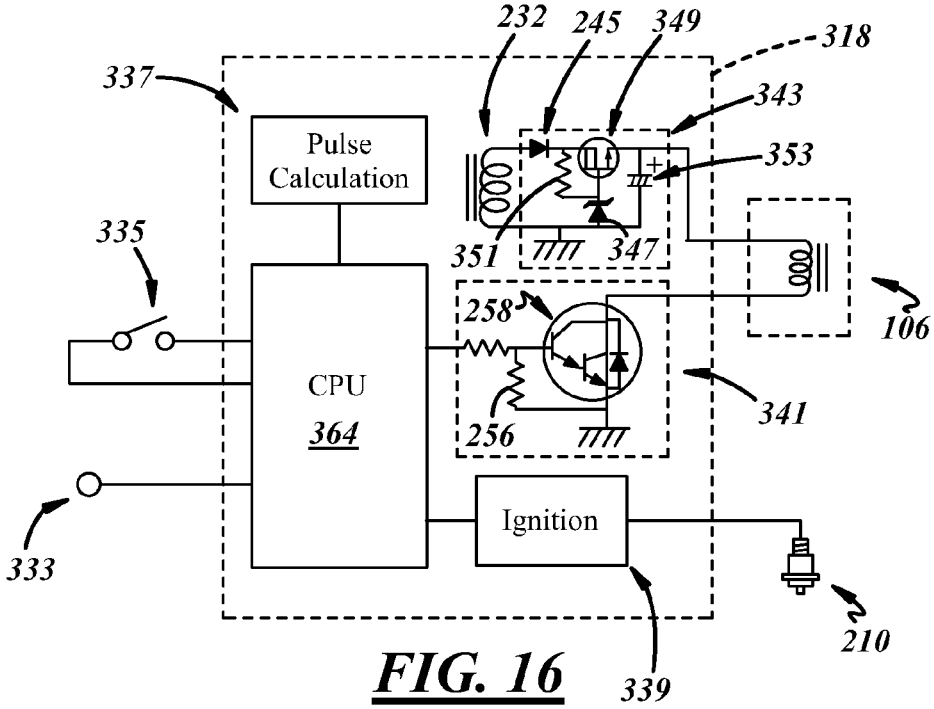
FIG. 16 is a block and schematic diagram for control of ignition and supplementary fuel supply.

FIG. 16 illustrates another presently preferred form of a power and control module (PCM) 318 and related components. This form is similar in many respects to the form of FIG. 7 and like numerals between the forms generally designate like or corresponding steps throughout the several views of the drawing figures. Accordingly, the descriptions of the PCMs 218, 318 are incorporated into one another by reference in their entireties. Additionally, the description of the common subject matter generally may not be repeated here.

In addition to the PCM 318, FIG. 16 also illustrates a temperature sensor 333 to sense engine temperature, a stop switch 335 to stop engine operation, the solenoid coil 106, the spark plug 210, and the valve power coil 232. The PCM 318 includes a pulse calculation block 337, which may represent suitable instructions for supplying supplementary fuel that may be executed by an electronic processing device 364 of the PCM 318. For example, the pulse calculation block 337 may represent the methodology described above with respect to methods 1200 and/or 1300.

The PCM 318 also includes an ignition block 339, which may include ignition circuitry similar to that described above with respect to FIG. 7. For example, the ignition block 339 may include the charge coil 236, the transformer 240, the ignition capacitor 252, and the switching device 254 of FIG. 7. In another example, the ignition block 339 may include any other suitable ignition circuitry.

The PCM 318 further includes a thermal switch 341 that may include the thermistor 256 and the transistor 258 to interrupt current flow to the solenoid coil 106 so as to terminate supplementary fuel supply when engine temperature exceeds a certain value.

Finally, in contrast to the PCM 218 of FIG. 7, here the PCM 318 includes a rectifying circuit 343 interposed between the valve power coil 232 and the solenoid coil 106. The valve power coil 232 has a negative pole to ground and a positive pole coupled in series to a diode 345 of the rectifying circuit 343. The circuit 343 also includes a zener diode 347 and an field-effect transistor (FET) 349 in parallel with the power coil 232 downstream of the diode 345, a resistor 351 in parallel across the FET 349 and having ends connected downstream of the diodes 345, 347, and a capacitor 353 in parallel with the power coil 232 downstream of the zener diode 347 and the FET 349.

The rectifying circuit 343 provides power to the coil 106 for the solenoid valve, may stabilize and retain suitable voltage in so doing, and may also protect electronic one or more components of the PCM 318 for long life and increased durability thereof. Those of ordinary skill in the art will recognize that the particular sizes and capacities of the components of the rectifying circuit 343 may be application specific and provided in accord with desired solenoid valve opening timing.

In general, the components of the engine and carburetor can be manufactured according to techniques known to those skilled in the art, including molding, machining, stamping, and the like. Also, the carburetor can be assembled according to known techniques. Likewise, any suitable materials can be used in making the components, such as metals, composites, polymeric materials, and the like.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A method of controlling supply of supplementary fuel to a supplementary fuel supply passage in a carburetor for supplying a fuel and air mixture to an engine having a piston connected to a rotary crankshaft, comprising:

providing an electromechanical valve in communication with and normally closing the supplemental fuel supply passage;

providing an electronic control module sensing engine crankshaft rotation and determining the crankshaft rotary speed;

providing a magneto device including a flywheel rotated by the crankshaft and having a magnet group, and a lamstack having at least a first leg carrying a first coil and a second leg carrying a second coil, with the magnet group and the lamstack first leg and first coil configured to produce a current for opening the electromagnetic valve created by the magnet group rotating past the lamstack first leg and the lamstack second leg and second coil configured to produce a current for powering the electronic control unit created by the magnet group rotating past the lamstack second leg; and the control unit controlling the supply of current to initially open the electromechanical valve only when the engine intake vacuum is at least about 80% of the peak engine intake vacuum, the engine crank angle is about 40° to 60° BTDC of the piston, the engine crankshaft speed is not greater than about 2,000 rpm, and the engine crankshaft has rotated not more than about 20 revolutions from initial cranking of the engine for starting the engine.

2. The method of claim 1 wherein the electromechanical valve is initially powered to open only when the engine intake vacuum is at least about 90% of the peak engine intake volume.

3. The method of claim 1 wherein the electromechanical valve is powered to initially open only if the current supplied by the first coil is at least about 65% of the peak current supplied by the first coil.

4. The method of claim 1 further comprising causing a spark for igniting a fuel-and-air mixture in the combustion chamber of the engine to occur at an engine crank angle of about 30° to 60° after the engine fuel and air mixture intake vacuum begins to peak.

5. The method of claim 1 which further comprises controlling the firing of a spark plug to ignite a fuel and air mixture within the combustion chamber of the engine to occur in the range of about 6° to 24° BTDC of the piston.

6. The method of claim 1 further comprising sensing the temperature of the engine within the first three revolutions of the crankshaft upon initial cranking of the engine and determining whether this engine temperature is greater than a predetermined temperature of not more than 95° F. and if the sensed temperature is greater than the predetermined temperature prohibiting opening of the electromechanical valve.

7. The method of claim 1 which further comprises intermittently opening the electromechanical valve for at least two cycles wherein each cycle includes a period in which the electromechanical valve is closed for at least two revolutions of the crankshaft and the total open time of the electromechanical valve for all of the cycles collectively is not more than about 20 revolutions of the crankshaft.

8. The method of claim 1 further comprising providing a rectifying electrical circuit interposed between the first coil and the electromechanical valve.

9. The method of claim 1 further comprising providing for only manual cranking of the engine for starting the engine.

10. The method of claim 1 wherein the engine is a two-cycle engine.

11. A system for supplying supplemental fuel through a carburetor to a fuel and air mixture intake of an engine with a piston connected to a rotatable crankshaft, the system comprising:

a supplementary fuel supply passage between a carburetor fuel chamber and an air-and-fuel mixing passage of the carburetor;

an electromechanical valve normally closing the passage;

an electronic control unit sensing engine crankshaft rotation and determining the crankshaft rotary speed;

a magneto device including a flywheel rotated by the engine crankshaft and carrying a magnet group, and a lamstack having a first leg carrying a first coil and configured to produce a current to power the electromechanical valve to open the passage by the magnet group rotating past the first leg and a second leg carrying a second coil and configured to produce a current to power the electronic control until when the magnet group rotates past the second leg; and the electronic control unit controlling the current to power the electromechanical valve to initially open the supplemental fuel supply passage only when the crank angle of the rotating crankshaft is about 40° to 60° BTDC of the piston, the sensed engine crankshaft rotary speed is not greater than about 2,000 rpm and the engine crankshaft has rotated for not more than about 20 revolutions from initial cranking of the engine for starting the engine.

12. The control system of claim 11 wherein the electromechanical valve is initially opened only when the current produced by the lamstack fist leg and first coil is at least about 65% of the peak current produced by the lamstack first leg and first coil.

13. The system of claim 11 further comprising the electronic control unit controlling a spark to ignite a fuel-and-air mixture in a cylinder of the engine to occur in the range of about 6° to 24° BTDC of the engine.

14. The control system of claim 11 wherein the engine control unit further comprises circuitry which within three revolutions of the crankshaft upon initial cranking the engine senses the temperature of the engine and determines whether the sensed engine temperature is greater than a predetermined temperature not greater than about 95° F. and if the sensed engine temperature is greater than the predetermined temperature prohibits powering of the electromechanical valve to open the supplemental fuel passage.

15. The system of claim 11 wherein the electronic control unit intermittently opens the control valve for at least two cycles wherein each cycle includes a period in which the electromechanical valve is closed for at least two revolutions of the crankshaft and the total open time of the electromechanical valve for all the cycles collectively is not more than about 20 revolutions of the crankshaft.

16. The system of claim 11 wherein the power and control module further comprises a rectifying electrical circuit interposed between the first coil and the electromechanical valve.

17. The system of claim 11 for a two-cycle engine.

18. The system of claim 11 for an engine which is only manually cranked for starting the engine.

19. The system of claim 11 for a two-cycle engine which is only manually cranked for starting the engine.

* * * * *

UNITED STATES PATENT AND TRADEMARK OFFICE

CERTIFICATE OF CORRECTION

PATENT NO. : 8,757,121 B1
APPLICATION NO. : 12/686198
DATED : June 24, 2014
INVENTOR(S) : Matthew A. Braun et al.

It is certified that error appears in the above-identified patent and that said Letters Patent is hereby corrected as shown below:

Title Page: Item (75) Inventors should read:

Matthew A. Braun
Gary J. Burns
Gerald J. LaMarr, Jr.
Brent N. Schermerhorn
Mikio Sato
Tsuyoshi Watanabe Signed and Sealed this
Twenty-first Day of October, 2014

Michelle K. Lee

Michelle K. Lee
*Deputy Director of the United States Patent and Trademark Office*